United States Patent [19]

Voigt, Jr.

[11] 4,000,021

[45] Dec. 28, 1976

[54] PROCESS FOR SUSPENDING PARTICULATE ADDITIVES IN MOLTEN TNT

[75] Inventor: H. William Voigt, Jr., Stanhope, N.J.

[73] Assignee: The United States of America as represented by the Secretary of the Army, Washington, D.C.

[22] Filed: Aug. 22, 1975

[21] Appl. No.: 606,821

[52] U.S. Cl. ..... 149/17; 149/20; 149/39; 149/107; 149/108.8

[51] Int. Cl.[2] ..... C06B 45/04; C06B 45/08; C06B 33/10; C06B 25/08

[58] Field of Search ..... 149/19, 19.7, 38, 39, 149/37, 105, 106, 107, 108.8, 118, 13, 20, 17, 21

[56] References Cited

UNITED STATES PATENTS

| | | | |
|---|---|---|---|
| 3,403,061 | 9/1968 | Mc Donald | 149/105 |
| 3,447,980 | 6/1969 | Voigt | 149/105 |
| 3,472,713 | 10/1969 | Berthmann | 149/105 |
| 3,536,544 | 10/1970 | Pennington | 149/106 |
| 3,676,235 | 7/1972 | Nuscher | 149/105 |
| 3,706,609 | 12/1972 | Voigt | 149/105 |
| 3,741,833 | 6/1973 | Falconer | 149/105 |
| 3,748,201 | 7/1973 | Jordan | 149/108.8 |

FOREIGN PATENTS OR APPLICATIONS

| | | | |
|---|---|---|---|
| 483,222 | 5/1952 | Canada | 149/107 |

OTHER PUBLICATIONS

Rose, The Condensed Chemical Dictionary, 7th Ed. (1966) p. 80.

*Primary Examiner*—Stephen C. Bentley
*Assistant Examiner*—Donald P. Walsh
*Attorney, Agent, or Firm*—Nathan Edelberg; A. Victor Erkkila

[57] ABSTRACT

Composite explosive slurries of good stability and flow properties are obtained by dispersing particulate solid components, e.g. RDX, $NH_4NO_3$ and Al, in molten TNT in the presence of a small amount of arabinogalactan or gum arabic to inhibit segregation of the suspended solids.

6 Claims, No Drawings

PROCESS FOR SUSPENDING PARTICULATE ADDITIVES IN MOLTEN TNT

GOVERNMENTAL INTEREST

The invention described herein may be manufactured, used and licensed by or for the Government for governmental purposes without the payment to me of any royalty thereon.

BACKGROUND OF THE INVENTION

Composite fusible explosive compositions based on TNT constitute an important class of military explosives. Examples of such composite explosive include Composition B (RDX - cyclotrimethylenetrinitramine and TNT - 2,4,6-trinitrotoluene), Cyclotols (RDX and TNT in ratios of 75/25, 70/30, 65/35, and 60/40 resp.), Amatol ($NH_4NO_3$ and TNT), Amatex ($NH_4NO_3$, RDX and TNT), Kalatol ($KNO_3$ and TNT), Baratol ($BA(NO_3)_2$ and TNT), Pentolite (pentaerythritol tetranitrate (PETN) and TNT) and Baronal ($Ba(NO_3)_2$, aluminum and TNT). Such compositions are generally prepared by stirring the powdered solid components, which include such materials as RDX, HMX (cyclotetramethylenetetranitramine), PETN, $NH_4NO_3$, $KNO_3$, $Ba(NO_3)_2$, $Pb(NO_3)_2$, $KClO_4$, $NH_4ClO_4$ and aluminum metal and mixtures thereof which are essentially insoluble in TNT, with the molten TNT until a homogeneous dispersion or slurry is obtained. The molten slurry is loaded into shells or other ordnance items by pouring into the cavity and allowing the melt to cool and solidify. Such slurries, which in concentrated cases are very viscous and difficult to pour, exhibit undesirable segregation or settling of the solids during the period required for cooling and solidification, thereby producing casts of non-uniform composition, which adversely affects the explosive and ballistic characteristics of the item. The rate of settling or segregation increases as the difference in density between the solid components and the molten TNT increases.

In the past various methods have been employed to overcome the aforesaid solids segregation problem, but such methods have not been entirely satisfactory or are of only limited suitability. The problem has been acceptably overcome by using small items and melting the composite TNT explosive to just above the melting point of the TNT and stirring the mass during the cooling of the melt, or by solidifying the small items rapidly. In the case of large items, the problem has been met in less satisfactory manner by introducing solidified chunks of the composite explosive into the partially loaded melt in the warhead to reduce the time required for the melt to solidify completely. It has also been proposed to incorporate small amounts of additives, such as finely divided silica, silicone resins, nitrocellulose and other cellulosic resins, to improve the suspension of the solid components in the TNT slurry. However, such additives are either not sufficiently effective or affect other properties of the slurry of cast explosive undesirably.

SUMMARY AND DETAILED DESCRIPTION OF THE INVENTION

An object of the present invention is to provide a process for dispersing particulate solid components in molten TNT to produce composite explosive slurries of good stability and flow properties.

Another object is to provide a process for dispersing particulate solids, such as RDX, HMX and aluminum, in molten TNT to produce slurries, which possess good stability and flow properties and on solidification produce composite cast explosives of uniform composition, which can be remelted and resolidified without loss of such uniformity.

Other objects will become apparent as the invention is further described.

In accordance with the present invention it has been found that composite explosive slurries of good stability and flow properties can be obtained by dispersing particulate solid components, such as RDX and other solid components employed in the production of composite TNT based explosives, as illustrated above, in molten TNT in the presence of a water-soluble gum selected from the group consisting of arabinogalactan and gum arabic, in an effective amount to inhibit segregation or settling of the solids from said dispersion. The explosive slurries obtainable thereby can be melt-loaded into shells to provide solid casts, wherein the particulate solids are uniformly distributed throughout the entire cast, including the riser scrap portion. The resulting casts and scrap portions can be remelted and reused without loss of uniformity of the composite explosive composition, thereby providing an important economic advantage.

It was not obvious that the gum arabic and arabinogalactan, which are water-soluble gums, would be soluble and stable in molten TNT and particularly effective and desirable for preparing composite TNT based explosive slurries of good stability and flow properties. Besides effectively stabilizing the suspension of the particulate solid components in the molten TNT and thus achieving uniformity of composition throughout the resultant cast, the gum employed according to the present invention improves pourability of the melt and reduces clinging of the melt to walls and orifices. Also, it has been found that the gum additive induces a relatively rapid crystallization of the TNT matrix, which produces the desired fine, random crystals of TNT and avoids the formation of large crystals and associated voids and fissures in the cast. The presence of the gum ordinarily has no significant adverse effect on other physical properties of the cast explosive, e.g. exudation and heat stability, or on explosive characteristics, e.g. detonation rate, output and pressure.

Arabinogalactan and gum arabic are water-soluble gums, which possess similar properties. Chemically they are largely composed of complex polysaccharides. Gum arabic (also know as gum acacia) is mainly a mixture of Ca, K and Mg salts of arabic acid in a complex of the saccharides arabinose, galactose and rhamnose, and glucuronic acid. Arabinogalactan, which can be obtained from the northwestern U.S. larch tree, is said to be a complex, highly branched copolymer of arabinose and galactose in a molar ratio of about one to six, resp.

The manner in which the ingredients are mixed together is not critical. A convenient method comprises adding the water-soluble gum to the molten TNT containing the particulate solid additive and stirring the resulting mixture until a homogeneous slurry is obtained. Other methods can be employed. For example, the gum may be mixed with the particulate solid additive before incorporation with the molten TNT, or it may be mixed with the molten TNT prior to incorporation of the particulate solid additive. The explosive slurry containing the gum suspending agent is preferably maintained at a temperature not greatly exceeding the melting point of the TNT, e.g. between about 80° and 100° C., especially 85–95° C., although higher temperatures can be employed.

Very small amounts of the water-soluble gum are effective for inhibiting or retarding the settling of suspended solids from the explosive slurries of the present invention. The amount of the gum suspending agent employed in the process of the present invention depends on the degree of stabilization of the slurry desired and to some extent on the surface area of the solid particles and the ratio of such solids to the TNT. Generally, with slurries containing about from 20% to 95% TNT and about from 5% to 80% total solid components, adequate stability and flow characteristics for casting into small or large solid charges can be obtained by employing the gum in an amount ranging about from 0.05% to 5%, preferably about from 0.1% to 2.0% by weight of the TNT content of the slurry. The use of more than the preferred concentrations of gum up to about 5% of the TNT content of the slurry is effective but is less economical and hence less preferred as it ordinarily provides no further advantage; however, the incorporation of the gum in an amount substantially greater than 5 weight percent of the TNT is generally undesirable, since it introduces an excessive amount of an inert diluent into the composite explosive composition. The amount of gum suspending agent employed can be reduced if the slurry contains small amounts of substances, e.g. nitrocellulose and other cellulosic resins, which are sometimes added to prevent exudation of oil from cast TNT explosives, since such resins also tend to promote suspension of the solids in molten TNT.

The following examples illustrate specific embodiments of the method of carrying out the process of the present invention. In the examples the percentages stated are by weight.

EXAMPLE 1.

A mixture of 25 grams RDX (average particle size 40 microns) and 50 grams TNT was heated to about 85° C. until the TNT was completely melted. The RDX particles settled noticeably from the molten TNT matrix. To the agitated molten slurry thus obtained was added 0.15 gram of STRactan-2 powder, a product marketed by the St. Regis Paper Co., New York, consisting of 98% arabinogalactan, which is a complex, highly branched polymer of arabinose and galactose in the ratio about 1:6 resp. The RDX particles were thereby maintained suspended in the melt. 50 grams of crushed ammonium nitrate prills (particle size between 150 and 1000 microns) preheated to about 85° C. were then added with agitation. The slurry thus obtained possessed excellent uniformity and good flow properties (Brookfield viscosity was 300 cps.) and did not cling to the container walls unlike the corresponding slurry containing no STRactan-2. It was poured into a metal container with heated riser and allowed to cool to a solid. The cast (including riser) possessed excellent uniformity, fine crystallinity and a Shore Durometer hardness of D55. The vacuum stability at 100° C./40 hours and exudation were unchanged versus the cast similarly obtained without STRactan-2.

EXAMPLE 2.

0.2 gram of STRactan-2 powder was stirred into 100 grams of a premelted mixture consisting of 60% RDX (average particle size 40 microns) and 40% TNT at a temperature of about 85° C. The resulting mixture was agitated at that temperature until a uniform suspension was obtained, then poured into a metal container with a heated riser and allowed to solidify. The resulting cast (including riser) possessed excellent uniformity and a Shore Durometer hardness of D55. The control cast similarly obtained without addition of STRactan-2 possessed a much less uniform composition and a Shore Durometer hardness of D45-50.

EXAMPLE 3.

0.36 gram of gum arabic powder was stirred into 100 grams of a premelted mixture of 60% RDX (average particle size 40 microns) and 40% TNT at about 85° C. The resulting mixture was agitated at that temperature until a homogeneous suspension was obtained and then solidified at 65–70° C. The hard, tough cast thus produced possessed exceilent uniformity, fine crystallinity and uniform Shore Durometer hardness of D50.

When 0.12 gram of nitrocellulose (12% nitrogen content and 1220 RS sec. viscosity) was initially incorporated in the RDX-TNT mixture to reduce oily exudation of the solid cast, only 0.2 gram of gum arabic was required to produce a stable suspension and cast of uniform composition in the above manner.

EXAMPLE 4.

0.4 gram of gum arabic powder was stirred into 100 grams of a premelted mixture of 40% crushed ammonium nitrate prills of particle size ranging from 150 to 1000 microns, 20% RDX (average particle size 40 microns) and 40% TNT at about 85° C. The mixture thus obtained was agitated at about 85° C. until a homogeneous suspension was produced and then allowed to cool and solidify. The cast thus obtained possessed excellent uniformity of composition and hardness as well as fine crystallinity.

When 0.15 gram of nitrocellulose (12% nitrogen, 1220 RS sec. viscosity) was added to the molten slurry to reduce oily exudation of the solid cast, only 0.2 gram of gum arabic powder was required to produce a stable suspension and similarly uniform cast.

The foregoing disclosure is merely illustrative of the principles of this invention and is not to be interpreted in a limiting sense. I wish it to be understood that I do not desire to be limited to the exact details of construction shown and described, because obvious modifications will occur to a person skilled in the art.

I claim:

1. An improved process for producing composite explosive slurries of good stability and flow properties, which comprises dispersing a particulate solid component in molten 2,4,6-trinitrotoluene the improvement wherein the molten 2,4,6-trinitrotoluene is in mixture with a water-soluble gum selected from the group consisting of arabinogalactan and gum arabic in an effective amount to inhibit segregation of said particulate solid component.

2. The process of claim 1, wherein the slurry contains about from 20 to 95 weight percent of 2,4,6-trinitrotoluene and about from 5 to 80 weight percent of particulate solid component.

3. The process of claim 2, wherein the solid component is selected from the group consisting of cyclotrimethylene-trinitramine, cyclotetramethylene-tetranitramine, pentaerythritol tetranitrate, $NH_4NO_3$, $KNO_3$, $Ba(NO_3)_2$, $Pb(NO_3)_2$, $NH_4ClO_4$, $KClO_4$ and aluminum metal, and mixtures thereof.

4. The process of claim 2, wherein the amount of the gum is about from 0.05 to 5.0 weight percent based on the 2,4,6-trinitrotoluene content of the slurry.

5. The process of claim 2, wherein the amount of the gum is about from 0.1 to 2 weight percent based on the 2,4,6-trinitrotoluene content of the slurry.

6. The process of claim 5, wherein the slurry consists essentially of about 60 weight percent cyclotrimethylenetrinitramine and about 40 weight percent 2,4,6-trinitrotoluene.

* * * * *